US011858020B2

(12) United States Patent
Sprock et al.

(10) Patent No.: US 11,858,020 B2
(45) Date of Patent: Jan. 2, 2024

(54) PROCESS FOR THE PRODUCTION OF A METALLIC STRIP OR SHEET

(71) Applicant: SMS GROUP GMBH, Duesseldorf (DE)

(72) Inventors: August Sprock, Duesseldorf (DE); Christoph Hassel, Duesseldorf (DE); Kai Grybel, Duesseldorf (DE)

(73) Assignee: SMS GROUP GMBH, Duesseldorf (DE)

( * ) Notice: Subject to any disclaimer, the term of this patent is extended or adjusted under 35 U.S.C. 154(b) by 152 days.

(21) Appl. No.: 17/436,518

(22) PCT Filed: Jan. 16, 2020

(86) PCT No.: PCT/EP2020/050975
§ 371 (c)(1),
(2) Date: Sep. 3, 2021

(87) PCT Pub. No.: WO2020/177937
PCT Pub. Date: Sep. 10, 2020

(65) Prior Publication Data

US 2022/0176429 A1 Jun. 9, 2022

(30) Foreign Application Priority Data

Mar. 6, 2019 (DE) ..... 102019203088.2

(51) Int. Cl.
*B21B 1/26* (2006.01)
*B21B 37/76* (2006.01)
(Continued)

(52) U.S. Cl.
CPC ..... *B21B 1/26* (2013.01); *B21B 37/76* (2013.01); *B21B 38/006* (2013.01); *B21B 45/004* (2013.01)

(58) Field of Classification Search
CPC ..... B21B 2261/20; B21B 2261/21; B21B 38/006; B21B 37/74; B21B 37/76
See application file for complete search history.

(56) References Cited

U.S. PATENT DOCUMENTS

2018/0043407 A1* 2/2018 Shimoda ..... C21D 11/00

FOREIGN PATENT DOCUMENTS

DE 2023799 A1 11/1970
DE 19963185 A1 7/2001
(Continued)

OTHER PUBLICATIONS

International Search Report, dated April 6, 20120 in corresponding International Application No. PCT/EP2020/050975.
(Continued)

*Primary Examiner* — Bobby Yeonjin Kim
(74) *Attorney, Agent, or Firm* — AMSTER, ROTHSTEIN & EBENSTEIN LLP

(57) ABSTRACT

A method for producing a metallic strip or sheet, in which the strip or sheet is rolled in a multi-stand rolling mill and is discharged downstream of the last roll stand of the rolling mill in a conveying direction. The strip or sheet is cooled in the multi-stand rolling mill and/or downstream of the rolling mill as viewed in the conveying direction, wherein a temperature of the strip or sheet is measured upstream of the last roll stand of the rolling mill as viewed in conveying direction. Based on this measured temperature, a temperature for the strip or sheet at the exit of the last roll stand of the rolling mill is then determined by calculation with the aid of a temperature calculation model, with which further temperature processes of the manufacturing method can be controlled or regulated after a comparison with a predetermined reference value.

17 Claims, 7 Drawing Sheets

(51) Int. Cl.
*B21B 38/00* (2006.01)
*B21B 45/00* (2006.01)

(56) References Cited

FOREIGN PATENT DOCUMENTS

| | | | | | |
|---|---|---|---|---|---|
| DE | 102013019698 | A1 | | 11/2014 | |
| DE | 102016200077 | A1 | | 6/2017 | |
| EP | 2505278 | A1 | | 10/2012 | |
| EP | 2546004 | A1 | * | 1/2013 | ..... B21B 37/74 |
| EP | 2546004 | A1 | | 1/2013 | |
| EP | 2959984 | B1 | | 5/2018 | |
| JP | S6156722 | A | | 3/1986 | |

OTHER PUBLICATIONS

Written Opinion of the International Search Authority dated Apr. 6, 2020 in corresponding International Application No. PCT/EP2020/050975.

* cited by examiner

PROCESS FOR THE PRODUCTION OF A METALLIC STRIP OR SHEET

CROSS REFERENCE TO RELATED APPLICATIONS

This application is a national phase of PCT application No. PCT/EP2020/050975, filed Jan. 16, 2020, which claims priority to DE patent application No. 102019203088.2, filed Mar. 6, 2019, all of which are incorporated herein by reference thereto.

FIELD OF INVENTION

The invention relates to a method for producing a metallic strip or sheet according to the preamble of claim 1.

BACKGROUND OF THE INVENTION

According to the prior art, in production plants for producing metal strips or sheets (for example hot strip mills or CSP plants), it is known to adjust the temperature profile for the strip or sheet over the length of the production plant. For example, DE 2 023 799 A discloses to provide a roller table with controllable spray devices for cooling a strip in a rolling mill with a finishing train, wherein the spray devices are controlled using a temperature control system. Provided along the conveying direction of the strip are a plurality of pyrometers, with which a respective temperature of the strip is measured. Based on an adaptive feedback of the temperatures measured with the pyrometer, the spray patterns (or the amount of supplied cooling water) can be changed or adjusted for a currently cooled strip.

EP 2,959,984 B1 discloses a method for manufacturing a hot-rolled steel sheet, wherein at an inner side of a last or final stand of a rolling mill, cooling water is sprayed at a lower process side of the final stand in a series of hot finishing rolling mills to achieve rapid cooling. A surface temperature of the rolling material is measured on an entry-side of the final stand to determine an entry-side surface temperature. The measured entry-side surface temperature and a predetermined entry-side target surface temperature are then compared with each other, and based on this comparison, a control command is sent to at least one unit formed of a coilbox, a raw billet heating device, a descaling device and/or an intermediate roll stand cooling device, so that the measured entry-side surface temperature equals the predetermined entry-side target surface temperature.

A known possible configuration of a hot strip mill or finishing mill includes a rapid cooling device immediately after or at the exit of the last roll stand of the finishing train, with which a strip or sheet is intensively cooled when it emerges from the finishing train in the conveying direction. In this case, it is not possible to measure the final rolling temperature of the strip or sheet after the last stand and before the first cooling at the exit of the finishing train.

The invention is based on the object to optimize the temperature control and/or at least one further process parameter in the production or processing of a strip or sheet metal with a multi-stand roll stand.

SUMMARY OF THE INVENTION

This object is achieved by a method with the features of the independent claim. Advantageous embodiments of the invention are defined in the dependent claims.

A method according to the present invention is used in the production of a metallic strip or sheet, in which the strip or sheet is rolled in a multi-stand rolling mill and is discharged behind the last roll stand of the rolling mill in the conveying direction. In the multi-stand rolling mill, the strip or sheet is cooled downstream of the rolling mill, as viewed in conveying direction, wherein a temperature of the strip or sheet is measured upstream of the last roll stand of the rolling mill, as viewed in conveying direction. This process includes of the following steps:

i) calculating a temperature for the strip or sheet immediately at the exit of the last stand of the rolling mill by means of a temperature calculation model on the basis of the temperature of the strip or sheet measured upstream of the last stand of the rolling mill, wherein this calculation step is carried out for a system formed by the material section of the strip or sheet between the point at which the temperature is measured upstream of the last mill stand and the exit of the last mill stand, (ii) comparing the temperature calculated for the strip or sheet at the exit of the last roll stand of the rolling mill with a predetermined reference value, and (iii) adjusting (e.g., closed-loop_controlling, preferably regulating) at least one process parameter for the strip or sheet, taking into account the comparison of the calculated temperature with the predetermined reference value according to step (ii), the strip or sheet being processed, heated or cooled as a function of this process parameter.

The at least one process parameter which is adjusted (e.g., controlled or regulated) according to step (iii) of the process according to the invention, taking into account or depending on the calculated temperature at the exit of the last roll stand of the rolling mill and the comparison made for this purpose, can be the temperature of an intermediate stand cooling system and/or a preliminary strip cooling system (influenced by the amount of cooling water supplied), which are each arranged upstream of the last roll stand or the rolling mill, as viewed in the conveying direction of the strip or sheet. Alternatively, the at least one process parameter can also be the temperature of an induction heater and/or a furnace, arranged upstream of the rolling mill as viewed in the conveying direction of the strip or sheet. In addition, or alternatively, the process parameter controlled or regulated according to the invention can also be the strip speed at which the strip or sheet is transported through the rolling mill. In addition, and/or alternatively, the process parameter can also be the operating position of a thermal insulation hood arranged upstream of the rolling mill as viewed in the conveying direction (F), the thermal insulation hood being opened or closed relative to the strip or sheet in step (iii) taking into account the comparison according to step (ii). In any case, the above-mentioned variants for the process according to the invention permit a targeted setting or influencing of temperatures of a strip or sheet during its manufacture.

It is noted that—if the process parameter is the temperature of a cooling device—the technical implementation in the associated system for the production or processing of a strip or sheet is achieved via the quantity of coolant supplied and/or the number of active or switched-on cooling zones or spray nozzles.

In the context of the present invention, it is noted that with regard to the production of a metallic strip or sheet, the knowledge of an exact temperature distribution and its compliance with predetermined set points are both of fundamental importance for obtaining a high-quality product, such as a thin or thick slab as well as billet or long products made of steel and iron alloys. The temperature distribution of the metal strand or a slab is therefore an important parameter, especially for the control of the machining process, e.g., within and/or downstream of a finishing line, which however cannot be measured directly at every point of a plant, e.g., by using pyrometers.

The invention is based on the essential finding that, with the aid of the calculation according to step (i), it is possible to determine a process parameter, e.g., in the form of the temperature for the strip or sheet, directly at the exit of the last roll stand of the rolling mill, in particular also in the case where a rapid cooling device follows the last roll stand. This calculated temperature can preferably be a surface temperature of the strip or sheet. In contrast, it is not possible according to the state of the art to determine a temperature of the strip or sheet, which is discharged in the conveying direction from this last roll stand, at the exit of the last roll stand of the rolling mill, if a rapid cooling device is located directly downstream of the last roll stand of a rolling mill. By comparing the computed temperature with a predetermined reference value according to step (ii), a cooling water supply can then be controlled, preferably regulated, in such a way that the temperature of the strip or sheet at the exit of the last roll stand of the rolling mill reaches this predetermined reference value. In addition and/or as an alternative to this, it is also possible to adjust (i.e. control or regulate) the cooling water supply for the strip or sheet in other areas of a plant with which the metallic strip or sheet is produced, taking into account the comparison according to step (ii), for example in an intermediate stand cooling system arranged upstream of the last roll stand, as viewed in the conveying direction, in a laminar cooling system arranged downstream of the last roll stand of the rolling mill, as viewed in the conveying direction, and/or in a rapid cooling system arranged immediately downstream of the last roll stand of the rolling mill, as viewed in the conveying direction.

The temperature calculation model used in step (i) is a preferably dynamic temperature control model or program. The calculation is performed using a finite difference method. This model allows, among other things, determining the temperature distribution depending on the process conditions in a respective section of the plant with which a metallic strip or sheet is produced or processed. This model or program can also be used for control purposes in a cooling zone of a plant with which a metallic strip or sheet is produced. The control variable can be the (surface) temperature of the strip or sheet, which is computed at the exit of the last roll stand of the rolling mill on the basis of or starting from the temperature of the strip or sheet measured upstream of the last roll stand of the rolling mill, as viewed in the conveying direction, e.g., with the aid of a pyrometer. When this variable is specified as a set value, the model/program calculates the quantities of water required to achieve these values/parameters in a respective cooling zone. The results are visualized immediately and updated with each new cyclic calculation. In this sense, an online calculation and control is present.

In an advantageous embodiment of the invention, the temperature distribution in the system (i.e. in the section of the strip or sheet situated between the point at which the temperature is measured upstream of the last roll stand of the rolling mill and the exit of the last roll stand) can be determined by means of the Fourier heat equation, shown below:

$$\rho c_p \frac{\partial T}{\partial t} - \frac{\partial}{\partial s}\left(\lambda \frac{\partial T}{\partial s}\right) = Q$$

in which:

ρ=the density, $c_p$=the specific heat capacity at constant pressure,

T=the calculated absolute temperature in Kelvin,

λ=the thermal conductivity, s=the associated location coordinate, t=the time and Q=the energy released in front of the rolling mill or upstream of it during the phase transition from liquid to solid of the system.

In an advantageous further embodiment of the invention, within the framework or application of the temperature calculation model, the temperature distribution in the system (i.e., in the section of the strip or sheet situated between the point where the temperature is measured upstream of the last roll stand of the rolling mill and the exit of the last roll stand) can be determined an enthalpy as the total free molar enthalpy (H) of the system by means of the Gibbs energy (G) at constant pressure (p), according to the equation:

$$H = G - T\left(\frac{\partial G}{\partial T}\right)_p$$

in which:

H=the molar enthalpy of the system,

G=the Gibbs energy of the system,

T=the absolute temperature in Kelvin and p=the pressure of the system.

In an advantageous further embodiment of the invention, within the framework or application of the temperature calculation model in the system (i.e. in the section of the strip or sheet located between the point at which the temperature is measured upstream of the last roll stand of the rolling mill and the exit of the last roll stand), the Gibbs energy (G) of the total system for a phase mixture can be determined as the sum of the Gibbs energies of the pure phases and their phase fractions according to the equation:

$$G=f^i/G^i+f^l G^l+f^{p\alpha}G^{p\alpha}+f^{e\alpha}G^{e\alpha}+f^{ec}G^{ec}$$

in which:

G=the Gibbs energy of the system, $f^i$=the Gibbs energy fraction of the respective phase or of the respective phase fraction in the overall system and $G^i$=the Gibbs energy of the respective pure phase or the respective phase fraction of the system.

As explained, the present invention allows targeted control or regulation of selected cooling zones of a plant with which a metallic strip or sheet is produced or processed with respect to the supplied coolant quantities. In other words, the method according to the invention is characterized in that at least one cooling zone of such a plant is controlled or regulated by means of the temperature calculation model designed as a metallurgical process model.

Since the Gibbs energies are available for virtually all materials produced worldwide today, the temperature profile in the system of the strip or sheet (i.e., in the section of the strip or sheet situated between the point at which the temperature is measured upstream of the last roll stand of the rolling mill and the exit of the last roll stand) can be determined as a function of the material, to thereby exactly calculate the temperature of the strip or sheet at the exit of the last roll stand of the rolling mill. The invention therefore also provides that the temperature profile in the material block or material section is determined and set as a function of the material by means of the temperature calculation model.

Since the method according to the invention allows very quickly and promptly calculating the temperature of the strip or sheet at the exit of the last roll stand of the rolling mill, the method or the calculation method is particularly suitable to be carried out online and to be used to control the manufacturing process for the strip or sheet. In an embodiment of the invention, the aforementioned temperature calculation model is used not only to determine the temperature of the strip or sheet online at the exit of the last roll stand of the rolling mill, but also to control at least one cooling zone of a plant used to produce such strip or sheet.

The present invention and the associated method allow achieving an improved quality of products and at the same time lowering the amounts of reject material.

BRIEF DESCRIPTION OF THE DRAWINGS

The invention is explained in more detail below, wherein the attached Figures serve facilitating understanding. In these Figures.

DETAILED DESCRIPTION OF THE PREFERRED EMBODIMENTS

Figure 6:
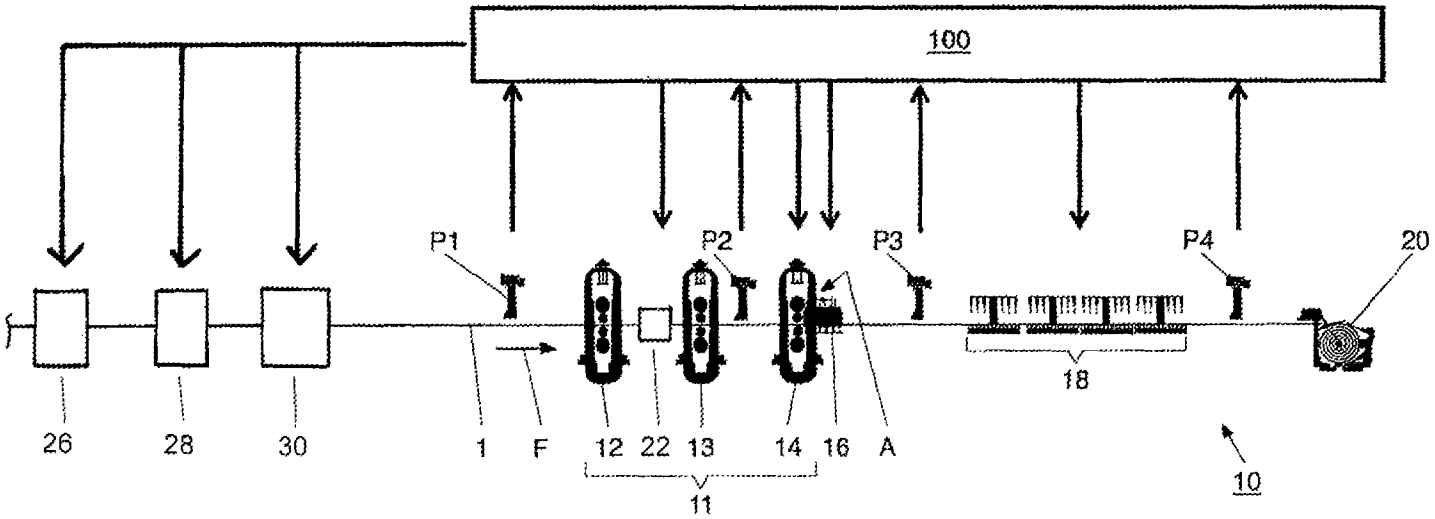
Figure 7:
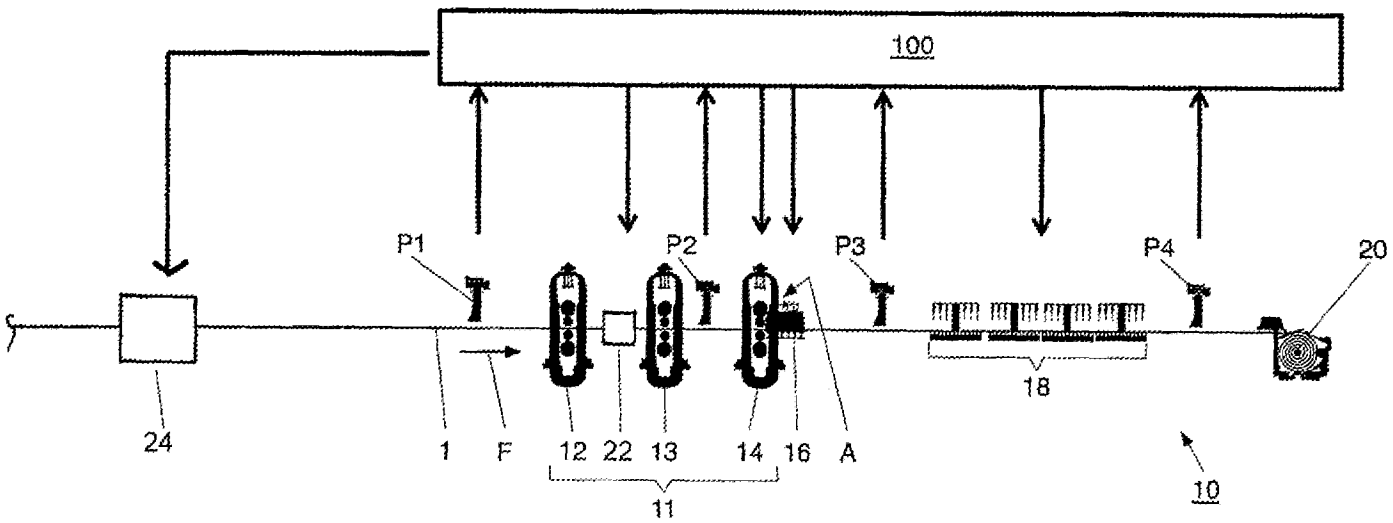

In the following, a preferred embodiment of a process according to the invention for producing a metallic strip or sheet 1 is explained with reference to FIGS. 1 to 7. It is noted that the drawing in FIG. 4, FIG. 6 and FIG. 7 is merely simplified and in particular shown without scale.

In the process according to the invention, a temperature calculation model is used with which a temperature that the produced metallic strip or sheet 1 possesses at an exit of a last roll stand of a rolling mill can be specifically calculated.

Prior to explaining the temperature calculation model and its application in a system for the production or processing of a strip or sheet in more detail, general principles relating to the temperature calculation for a metallic strip or sheet are explained:

The basis of the temperature calculation is Fourier's heat equation (1), in which cp represents the specific heat capacity of the system, λ the thermal conductivity, p the density and s the spatial coordinate. T indicates the calculated temperature. The term Q on the righthand side accounts for energies released during the phase transformation (equation 2). In the transition from liquid to solid, this term denotes the heat of fusion, $f_s$ indicates the degree of phase transformation.

$$\rho c_p \frac{\partial T}{\partial t} - \frac{\partial}{\partial s}\left(\lambda \frac{\partial T}{\partial s}\right) = Q \tag{1}$$

$$Q = \rho L \frac{\partial f_s}{\partial t} \tag{2}$$

Among the necessary input variables of the equation, the thermal conductivity and the total enthalpy are particularly important since these quantities significantly influence the temperature result. The thermal conductivity is a function of temperature, chemical composition and phase fraction and can be accurately determined experimentally.

The total enthalpy H or the molar enthalpy of a material portion or material section can be calculated using the Gibbs energy as follows (3):

$$H = G - T\left(\frac{\partial G}{\partial T}\right)_p \tag{3}$$

with the molar Gibbs energy G of the system. For a phase mixture, the Gibbs energy of the total system can be calculated via the Gibbs energies of the pure phases as well as their phase fractions $$G = f^i G^i + f^l G^l + f^{p\alpha} G^{p\alpha} + f^{e\alpha} G^{e\alpha} + f^{ec} G^{ec} \tag{4}$$

with the phase fractions $f^\varphi$ of the phase φ and $G^\varphi$ the molar Gibbs energy of this phase. For the austenite, ferrite and liquid phase (φ), the Gibbs energy is given by $$G^\phi = \Sigma_{i=1}^{n} x_i^\phi G_i^\phi + RT\Sigma_{i=1}^{n} x_i \ln(x_i + {}^E G^\phi + {}^{magn} G^\phi \tag{5}$$

$${}^E G^\phi = \Sigma x_i x_j {}^a L_{i,j}^\phi (x_i - x_j)^a + \Sigma x_i x_j x_k L_{i,j,k}^\phi \tag{6}$$

$${}^{magn} G^\phi = RT \ln(1+\beta) f(\tau) \tag{7}$$

In equation (4), the terms each correspond to a single-element energy, a contribution for the ideal mixture, as well as a contribution for the non-ideal mixture and the magnetic energy (equation 7). If the Gibbs energy of the system is known, the molar specific heat capacity can be calculated therefrom:

$$c_p = -T\left(\frac{\partial^2 G}{\partial T^2}\right)_p \tag{8}$$

The parameters of the terms of equations (5)-(7) are listed in a Thermocalc and Matcalc database and can be used to determine the Gibbs energies of a steel composition. With the aid of a mathematical derivation, this yields the total enthalpy of this steel composition.

Figure 1:
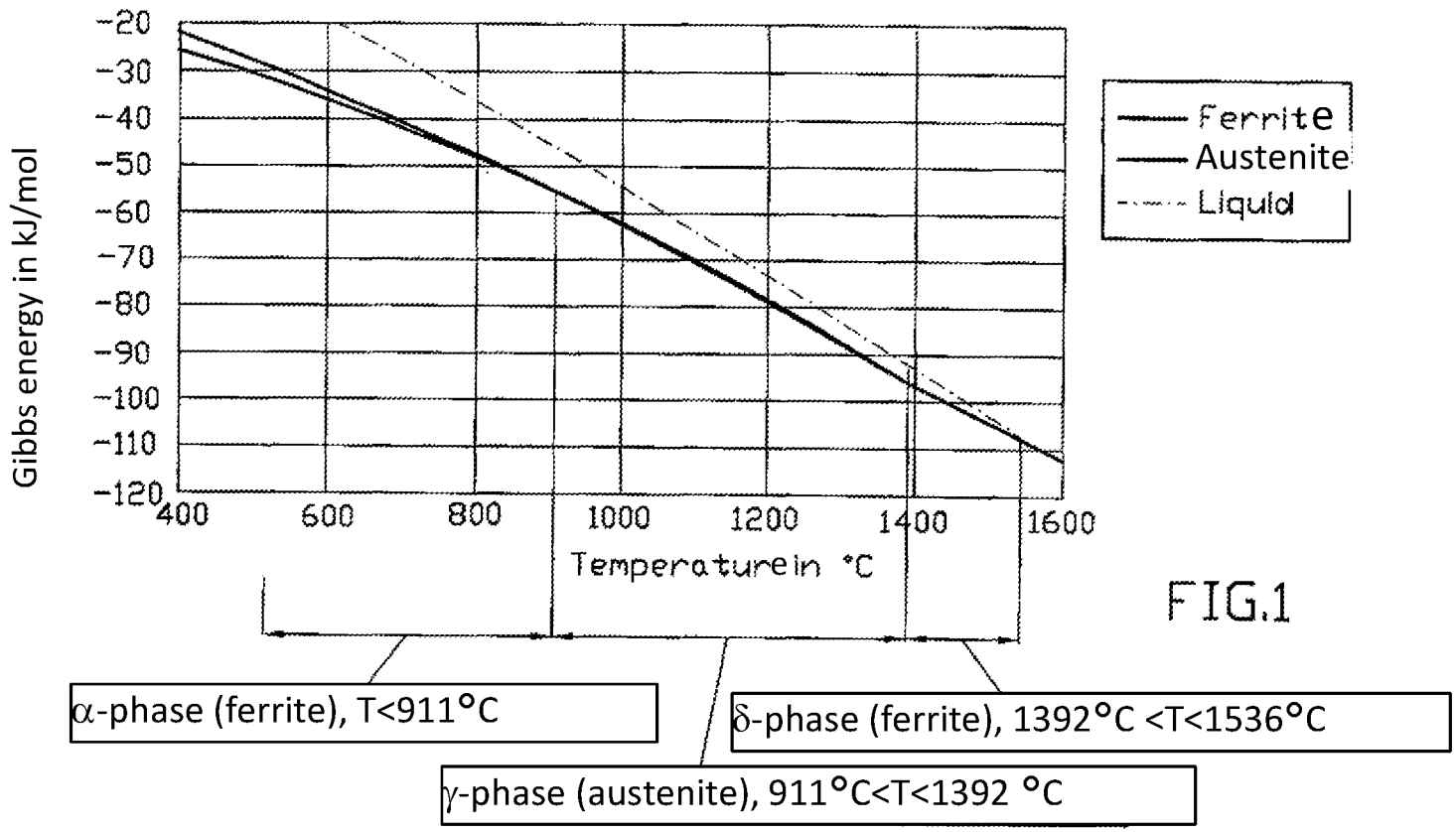
FIG. 1 shows the Gibbs energy for pure iron.

FIG. 1 shows the representation of the Gibbs energy for pure iron. This shows that the individual phases ferrite, austenite and the liquid phase assume a minimum for a certain characteristic temperature range at which these phases are stable.

Figure 2:
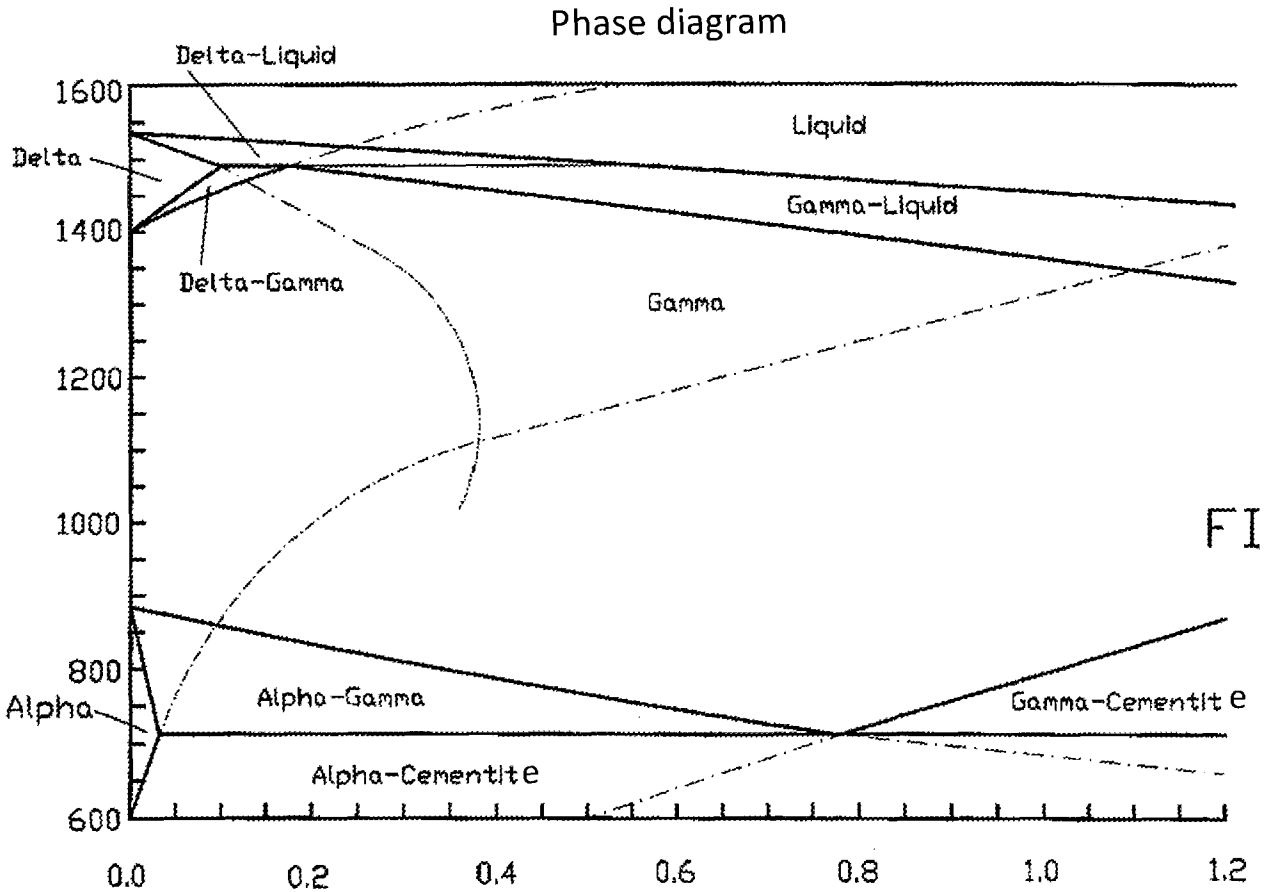
FIG. 2 is a (constructed) phase diagram with Gibbs energies, 3 shows the course of the total enthalpy by Gibbs for a coal-fuel lean steel.

FIG. 2 shows the phase boundaries of an Fe—C alloy with 0.02% Si, 0.310% Mn, 0.018% P, 0.007% S, 0.02% Cr, 0.02% Ni, 0.027% Al and variable C content. With the formulation of the Gibbs energy, it is possible to construct such a phase diagram with any chemical composition and show the stable phase fractions.

Figure 3:
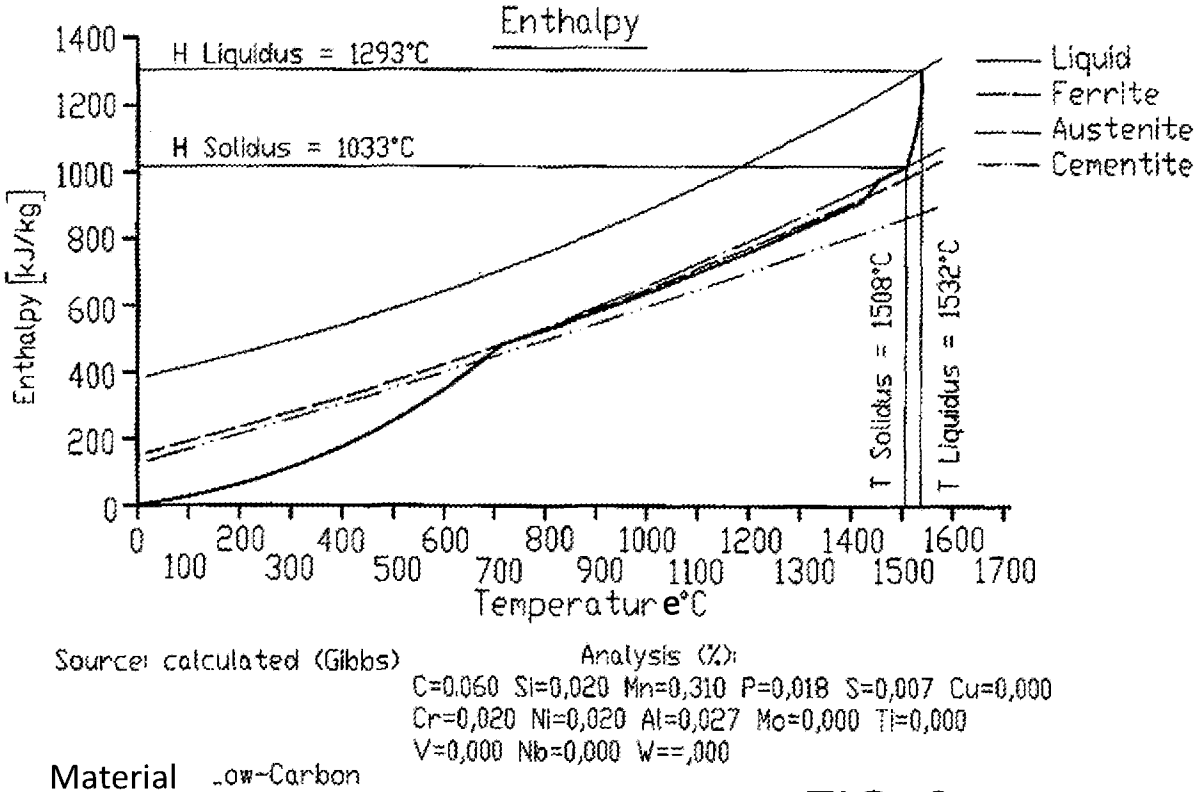
Figure 4:
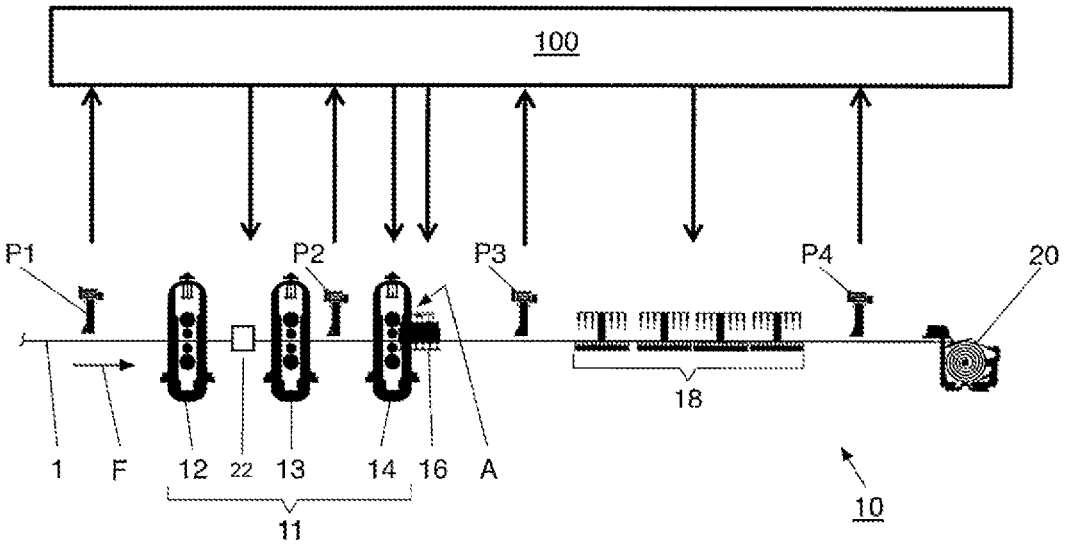
FIG. 4 shows a schematic simplified side view of a system with which a metallic strip or sheet is produced according to a method according to the invention.

FIG. 3 shows the Gibbs total enthalpy curve for a low carbon steel as a function of temperature. The solidus and liquidus temperatures are also shown in the figure.

FIG. 4 shows a simplified schematic side view of a plant 10 set up for the application of the process according to the invention, with which a strip or sheet 1 is produced or processed in a conveying direction F.

The plant 10 includes a multi-stand rolling mill 11, which in the shown example has a first roll stand 12, a center roll stand 13 and a last roll stand 14. Located immediately downstream of the last roll stand 14 or at its exit A is a rapid cooling device 16, followed by a further cooling in the form of a laminar cooling device 18. At the end of the production line, a reel 20 is provided with which a finished strip 1 can be wound up.

Between the first roll stand 12 and the center roll stand 13, an unspecified intermediate stand cooling system is provided for the rolling mill 11.

In the illustration of FIG. 4, arrow "F" indicates a conveying direction (from left to right in the drawing plane) in which a strip or sheet 1 is moved in the plant 10 or passes through the rolling mill 11 with the mentioned roll stands 12-14.

The system 10 includes several temperature measuring devices to measure the temperature of the strip or sheet at various points. These temperature measuring devices include: a first pyrometer P1, arranged upstream of the first roll stand 12 as viewed in conveying direction F; a second pyrometer P2, which is arranged between the second roll stand 13 and the last roll stand 14 (and thus upstream of the last roll stand 14 as viewed in conveying direction F); a third pyrometer P3 arranged between the rolling mill 11 and the laminar cooling device 18, as viewed in the conveying direction F; and a fourth pyrometer P4 arranged between the laminar cooling device 18 and the coiler 20.

With regard to the second pyrometer P2, which is arranged upstream of the last roll stand 14 as viewed in conveying direction F, it is separately emphasized that it is used to measure a temperature T2 which the strip or sheet 1 possesses prior to entering the last roll stand 14. Similarly, the temperatures measured by the pyrometers P1, P3 and T4, are hereinafter respectively designated T1, T3 and T4.

The use of the rapid cooling device 16 results in the strip or sheet 1 being cooled between the second pyrometer P2 (=T2) and the third pyrometer P3 (=T3) at a cooling rate CR23. The same applies to the area between the third pyrometer P3 (=T3) and the fourth pyrometer P4 (=T4), in which the laminar cooling device 18 is used for cooling at a cooling rate CR34.

The system 10 further includes a computing and control device, hereinafter briefly referred to as the control device, designated by "100" in FIG. 4, and symbolized in simplified form by a rectangle. The control device 100 is equipped with the temperature calculation model. The temperature calculation model can have or be based on a DTR or DSC (Dynamic Temperature Control/Dynamic Solidification Control). The calculation is carried out using a finite difference method.

The vertical arrows shown in the illustration of FIG. 4 between the plant 10 and the rectangle for the control device 100, symbolize the interactions between individual components of the plant 10 and the control device 100. Specifically, the arrows pointing upwards in each case illustrate that the temperatures measured by the pyrometers P1-P4 in each case are input into the control device 100 and processed therein in terms of signal technology. The arrows pointing downwards in each case symbolize that the associated components of the plant 10 can be controlled or regulated by the control device 10—this relates to the intermediate stand cooling (between the first roll stand 12 and the central roll stand 13), the last roll stand 14, the rapid cooling device 16 and/or the laminar cooling device 18, for example with regard to the supply of a coolant quantity to these components.

Using the aforementioned temperature calculation model, a temperature TFM present for the strip or sheet 1 immediately at the exit A of the last roll stand 14 is computationally determined based on or starting from the temperature T2 that was measured by the second pyrometer P2 upstream of the last roll stand 14, and input to the control device 100 as explained. This calculation is carried out according to the finite difference method for a system of the strip or sheet 1 formed by the material section of the strip or sheet 1 situated between the point at which the second pyrometer P2 is arranged and the exit A of the last roll stand 14. As explained above, in order to calculate this temperature profile or temperature TFM, the Fourier heat equation is solved. The boundary conditions in the rolling mill 11 (e.g., temperature output to air via radiation and convection as well as to the rolls of the last roll stand 14) and in the cooling section (temperature output to water cooling, air and roller table) are taken into account. Also taken into account is the heat generated by phase transformation, which can occur either in the rolling mill 11 or in the cooling section.

Figure 5:
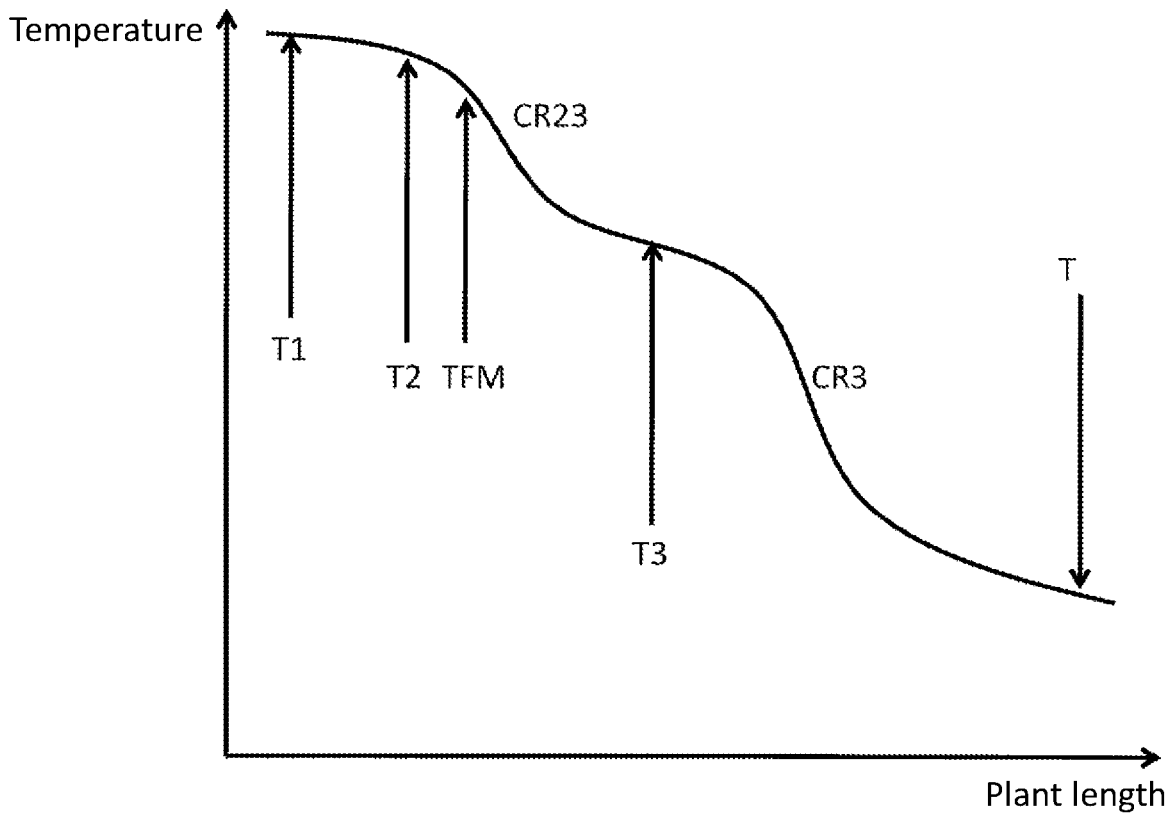
FIG. 5 shows a temperature profile for the strip or sheet metal over the length of the system from FIG. 4, and FIGS. 6 and 7 each show schematic simplified side views of a system according to an embodiment supplemented in comparison to FIG. 4, with which a metallic strip or sheet is produced according to a method according to the invention.

The various temperatures T1-T4 which occur along the length of the plant 10 for a strip or sheet 1 produced with the plant are shown in the diagram of FIG. 5 with a corresponding curve. The diagram also shows the calculated temperature TFM (at the exit A of the last roll stand 14) and the cooling rates CR23 and CR 34 explained above.

Following computation of the temperature TFM, the computed temperature is then compared by the control device 100 with a predetermined reference value TFMref. Taking this comparison into account, a cooling water supply for the strip or sheet 1 is then suitably adjusted, i.e., controlled or regulated, by means of the control device 100, if necessary. The control (or regulation) of the cooling water supply may have the purpose to make a temperature of the strip or sheet 1 at the exit A of the last roll stand 14 to correspond with the predetermined reference value TFMref, and/or to suitably adjust the further temperatures T3 (for pyrometer P3) and/or T4 (for pyrometer P4).

FIG. 6 shows a further embodiment of the plant 10 which, compared with the embodiment of FIG. 4, additionally includes the components inductive heating 26, furnace 28 and/or thermal insulation hood 30. As can be seen, these components 26, 28, 30 are each arranged upstream of the rolling mill 11, as viewed in the conveying direction F of the strip or sheet, with the strip or sheet 1 being able to be guided through these components. The arrows extending from the control device 100 towards these components 26, 28 and 30, illustrate that the inductive heater 26, the furnace 28 and/or the thermal insulation hood 30 can be controlled or regulated by means of the control device 100, namely, as explained above, as a function of the calculated temperature TFM and the comparison with the predetermined reference value TFMref made therewith. In this way, a temperature for the strip or sheet 1 is specifically influenced or increased.

The thermal insulation hood 30 operates as a device that thermally insulates the strip or sheet 1. Opening or closing the thermal insulation hood 30 allows influencing the degree of thermal insulation for the strip or sheet 1 on a roller table. By controlling the thermal insulation hood 30 with the control device 100, the thermal insulation hood 30 is opened or closed accordingly, or also caused to assume an intermediate position, whereby the temperature for the strip or sheet 1 is influenced in dependence on the respective position of the thermal insulation hood 30 11.

In the embodiment of FIG. 7, a preliminary strip cooling 24 is provided for the plant 10 upstream of the rolling mill 11, viewed in the conveying direction F of the strip or sheet 1, which preliminary strip cooling 24 can also be controlled or regulated by means of the control device 100, as indicated by the arrow. Depending on the calculated temperature TFM and the comparison with predetermined reference value TFMref, a coolant quantity for this preliminary strip cooling 24 is then controlled or regulated in order to influence or reduce the temperature of the strip or sheet 1 in a targeted manner.

In the illustrations of FIGS. 4, 6 and 7, "22" symbolizes an intermediate stand cooling, which can also be controlled or regulated by means of the control device 100, namely by adjusting the amount of coolant supplied and/or by the number of spray nozzles used.

In another embodiment of the process according to the invention, it can be provided that in the control device 100 or for the temperature calculation model stored therein, corresponding reference values T1ref, T2ref, T3ref, T4ref are also specified for the temperatures T1, T2, T3 and T4 on the basis of a microstructure model to enable achieving optimum properties. Alternatively, the reference values would have to be determined on the basis of empirical values or measurement and production data. These could be models based on neural networks, the Kriging algorithm or the like.

In the case of deviations of T2 from T2ref, it can also be decided with the aid of the microstructure model that this deviation does not result in a quality degradation of the strip 1 to be produced. For this case, the measured value for the temperature T2 then becomes the new target value for this strip, with new target values being calculated accordingly for T3 and T4. In addition, the cooling rates CR23 and/or CR34 can be changed to achieve the same characteristics due to the changed temperature profile. The same applies to deviations of T3 from T3ref or T4 from T4ref.

It is also possible to make this decision using a data-based empirical model based on the available measurement and production data. These can for example include models based on neural networks, the Kriging algorithm or the like.

The temperature calculation can be carried out via the Gibbs energies and the enthalpy. In this respect, reference is made to the above explanations of equations (1)-(8).

LIST OF REFERENCE SYMBOLS

1 strip or sheet
10 plant
11 rolling mill
12 first roll stand (of rolling mill 11)
13 middle roll stand (of rolling mill 11)
14 last roll stand (of rolling mill 11)
16 rapid cooling device
18 laminar cooling device
20 reel
22 inter-stand cooling
24 preliminary strip cooling
26 inductive heating
28 furnace
30 thermal insulation hood
100 computing and control device
A exit (of the last roll stand 14)
F direction of conveyance (for the strip or sheet 1)
P1 first pyrometer
P2 second pyrometer
P3 third pyrometer
P4 fourth pyrometer
T1-T4 temperatures of the strip or sheet 1, at the measuring point of the pyrometer P1-P4

We claim:

1. A method for producing a metallic strip or sheet, in which the metallic strip or sheet is rolled in a multi-stand rolling mill and is discharged in a conveying direction behind a last roll stand of the multi-stand rolling mill, wherein the metallic strip or sheet is cooled in the multi-stand rolling mill and/or downstream of the multi-stand rolling mill as viewed in the conveying direction, wherein a temperature (T2) of the metallic strip or sheet is measured upstream of the last roll stand of the multi-stand rolling mill as viewed in the conveying direction, the method comprising the steps of:

(i) calculating a temperature (TFM) for the metallic strip or sheet immediately at an exit of the last roll stand of the multi-stand rolling mill by means of a temperature calculation model on a basis of the temperature (T2) of the metallic strip or sheet measured upstream of the last roll stand of the multi-stand rolling mill, wherein said calculating a temperature (TFM) step is carried out for a system formed by a material section of the metallic strip or sheet between a point at which the temperature (T2) is measured upstream of the last roll stand, and the exit of the last roll stand, (ii) comparing the temperature (TFM) calculated for the metallic strip or sheet at the exit of the last roll stand of the multi-stand rolling mill with a predetermined reference value ($TFM_{ref}$), and (iii) adjusting at least one process parameter for the metallic strip or sheet, taking into account a comparison of the calculated temperature (TFM) with the predetermined reference value ($TFM_{ref}$) according to step (ii), wherein, depending on the at least one process parameter, the metallic strip or sheet is processed, heated or cooled.

2. The method according to claim 1, wherein the temperature (TFM) calculated in step (i) is a surface temperature of the metallic strip or sheet.

3. The method according to claim 1, wherein the at least one process parameter includes a temperature of an intermediate stand cooling of the multi-stand rolling mill arranged upstream of the last roll stand, as seen in the conveying direction, the temperature of the intermediate stand cooling being controlled in step (iii) by taking into account the comparison according to step (ii).

4. The method according to claim 1, wherein the at least one process parameter includes a temperature of a preliminary strip cooling arranged upstream of the multi-stand rolling mill, as seen in the conveying direction, the temperature of the preliminary strip cooling being controlled in step (iii) by taking into account the comparison according to step (ii).

5. The method according to claim 1, wherein the at least one process parameter includes a temperature of an inductive heater arranged upstream of the multi-stand rolling mill, as seen in the conveying direction, the temperature of the inductive heater being controlled in step (iii) la taking into account the comparison according to step (ii).

6. The method according to claim 1, wherein the at least one process parameter includes a temperature of a furnace arranged upstream of the multi-stand rolling mill, as seen in the conveying direction, the temperature of this the furnace being controlled in step (iii) by taking into account the comparison according to step (ii).

7. The method according to claim 1, wherein the at least one process parameter includes an operating position of a thermal insulation hood arranged upstream of the last roll stand, as seen in the conveying direction, the thermal insulation hood being opened or closed relative to the metallic strip or sheet in step (iii) by taking into account the comparison according to step (ii).

8. The method according to claim 1, wherein in step (iii) a laminar cooling device arranged downstream of the last roll stand of the multi-stand rolling mill, as viewed in the conveying direction, is controlled by taking into account the comparison according to step (ii).

9. The method according to claim 1, wherein in step (iii), a rapid cooling device arranged immediately downstream of the last roll stand of the multi-stand rolling mill, as viewed in the conveying direction, is controlled by taking into account the comparison according to step (ii).

10. The method according to claim 1, wherein the at least one process parameter includes the temperature of an intermediate cooling of the multi-stand rolling mill arranged upstream of the last roll stand, as seen in the conveying direction, the temperature of the intermediate cooling being controlled in step (iii) by taking into account the comparison according to step (ii).

11. The method according to claim 1, wherein, within the temperature calculation model, a total enthalpy is determined as a total free molar enthalpy (H) of the system by means of Gibbs energy at a constant pressure (p) according to the equation:

$$H = G - T\left(\frac{\partial G}{\partial T}\right)_p,$$

wherein

H=molar enthalpy of the system,

G=the Gibbs energy of the system,

T=absolute temperature in Kelvin, and p=pressure of the system.

12. The method according to claim 1, wherein within a framework of the temperature calculation model, a temperature distribution in the system and at the exit of the last roll stand of the multi-stand rolling mill is calculated by means of a Fourier heat equation:

$$\rho c_p \frac{\partial T}{\partial t} - \frac{\partial}{\partial s}\left(\lambda \frac{\partial T}{\partial s}\right) = Q,$$

wherein

ρ=density, $c_p$=specific heat capacity at constant pressure,

T=calculated absolute temperature in Kelvin,

λ=thermal conductivity, s=associated location coordinate, t=time, and

Q=energy released in front of the multi-stand rolling mill or upstream of it during phase transition from liquid to solid of the system.

13. The method according to claim 1, wherein in a context of the temperature calculation model for a phase mixture, the Gibbs energy (G) of the system overall is calculated as a sum of Gibbs energies of pure phases and their phase fractions according to the equation:

$$G=f^i/G^i+f^\gamma G^\gamma+f^{p\alpha}G^{p\alpha}+f^{e\alpha}G^{e\alpha}+f^{ec}G^{ec}, \text{ wherein}$$

G=the Gibbs energy of the system, $f_i$=the Gibbs energy share of a respective phase or of a respective phase share in the overall system, and $G^i$=the Gibbs energy of the respective pure phase or the respective phase fraction of the system.

14. The method according to claim 1, wherein the predetermined reference value ($TFM_{ref}$) is determined with a microstructure model for setting desired material properties.

15. The method according to claim 14, wherein based on the microstructure model, in case of a deviation of the predetermined reference value ($TFM_{ref}$) from the calculated temperature (TFM), a probability of a quality degradation of material is determined, and in an instance in which the determined probability of a quality degradation does not exceed a predetermined threshold, the calculated temperature (TFM) is then set as a new predetermined reference value ($TFM_{ref}$).

16. The method according to claim 14, wherein the microstructure model for compensation of possible quality devaluations contains new reference values for a temperature (T3, T4) of the metallic strip or sheet also at a position downstream of the last roll stand of the multi-stand rolling mill and/or downstream of a laminar cooling device arranged downstream of the last roll stand of the multi-stand rolling mill, when viewed in the conveying direction, as well as associated cooling rates (CR23, CR34).

17. The method according to claim 14, wherein the microstructure model is formed by a data-based model based on a Kriging algorithm and/or from neural networks.

* * * * *